US012593872B2

(12) United States Patent
Batista et al.

(10) Patent No.: US 12,593,872 B2
(45) Date of Patent: Apr. 7, 2026

(54) CARTRIDGE FOR USE WITH AN AEROSOL-GENERATING DEVICE

(71) Applicant: Philip Morris Products S.A., Neuchatel (CH)

(72) Inventors: Rui Nuno Rodrigues Alves Batista, Morges (CH); Valerio Oliana, Pully (CH); Alexandra Sereda, Zurich (CH); Gianluca Bongiovanni, Boudry (CH); Bekele Alemu Bedasso, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 478 days.

(21) Appl. No.: 18/256,959

(22) PCT Filed: Dec. 6, 2021

(86) PCT No.: PCT/EP2021/084446
§ 371 (c)(1),
(2) Date: Jun. 12, 2023

(87) PCT Pub. No.: WO2022/128583
PCT Pub. Date: Jun. 23, 2022

(65) Prior Publication Data

US 2024/0049791 A1 Feb. 15, 2024

(30) Foreign Application Priority Data

Dec. 17, 2020 (EP) ..... 20215112

(51) Int. Cl.
*A24F 40/42* (2020.01)
*A24F 40/465* (2020.01)
*A24F 40/485* (2020.01)

(52) U.S. Cl.
CPC ..... *A24F 40/42* (2020.01); *A24F 40/465* (2020.01); *A24F 40/485* (2020.01)

(58) Field of Classification Search
None
See application file for complete search history.

(56) References Cited

U.S. PATENT DOCUMENTS

2016/0044963 A1 2/2016 Saleem
2016/0120221 A1 5/2016 Mironov et al.
(Continued)

FOREIGN PATENT DOCUMENTS

CN 108378424 A 8/2018
EA 35963 B1 9/2020
(Continued)

OTHER PUBLICATIONS

Russian Notice of Allowance and Search Report issued May 28, 2025, in corresponding Russian Patent Application No. 2023118322/03(039334) (with English Translation of Category of Cited Documents), 10 pages.
(Continued)

*Primary Examiner* — Michael H. Wilson
*Assistant Examiner* — Daniel Edward Vakili
(74) *Attorney, Agent, or Firm* — Oblon, McClelland, Maier & Neustadt, L.L.P.

(57) ABSTRACT

A cartridge for an aerosol-generating device is provided, the cartridge being engageable with and disengageable from the device, the cartridge including: a mouthpiece; a housing including a susceptor material, the housing defining a cavity configured to receive an aerosol-forming substrate; and an ejector, a portion of the ejector being slideable within the cavity so as to eject the aerosol-forming substrate from the cavity. An aerosol-generating system including an aerosol-generating device and the cartridge is also provided.

15 Claims, 3 Drawing Sheets

(56) References Cited

U.S. PATENT DOCUMENTS

| | | | |
|---|---|---|---|
| 2017/0347715 | A1 | 12/2017 | Mironov et al. |
| 2020/0390149 | A1 | 12/2020 | Hepworth et al. |
| 2021/0052004 | A1 | 2/2021 | Mironov et al. |
| 2022/0295880 | A1* | 9/2022 | An ..... A61M 11/042 |

FOREIGN PATENT DOCUMENTS

| | | | |
|---|---|---|---|
| EP | 2 782 463 | B1 | 6/2016 |
| EP | 2 964 038 | B1 | 7/2016 |
| JP | 2007-267749 | A | 10/2007 |
| JP | 2016-524458 | A | 8/2016 |
| JP | 2018-528765 | A | 10/2018 |
| JP | 2019-506892 | A | 3/2019 |
| JP | 2020-96584 | A | 6/2020 |
| RU | 2 704 891 | C2 | 10/2019 |
| WO | WO 2013/076098 | A2 | 5/2013 |
| WO | WO 2015/177046 | A1 | 11/2015 |
| WO | WO 2018/114313 | A1 | 6/2018 |
| WO | WO 2019/073237 | A1 | 4/2019 |
| WO | WO 2019/101947 | A1 | 5/2019 |
| WO | WO 2019/234195 | A1 | 12/2019 |
| WO | WO 2020/115155 | A1 | 6/2020 |
| WO | WO 2020/148334 | A1 | 7/2020 |
| WO | WO 2020/213917 | A2 | 10/2020 |
| WO | WO2020/222530 | A1 | 11/2020 |

OTHER PUBLICATIONS

International Search Report & Written Opinion issued Apr. 4, 2022 in PCT/EP2021/084446 filed on Dec. 6, 2021, 8 pages.
Extended European Search Report issued Jun. 11, 2021 in European Patent Application No. 20215112.2, 7 pages.
Notice of Allowance dated Jan. 13, 2026, issued in corresponding Japanese Patent Application No. 2023-535409.

* cited by examiner

CARTRIDGE FOR USE WITH AN AEROSOL-GENERATING DEVICE

The present disclosure relates to a cartridge for use with an aerosol-generating device. The present disclosure also relates to an aerosol-generating system.

Aerosol-generating devices configured to generate an aerosol from an aerosol-forming substrate, such as a tobacco-containing substrate, are known in the art. Such known devices may generate aerosol from the substrate through the application of heat to the substrate, rather than combustion of the substrate. The aerosol-forming substrate may be present as a component part of an aerosol-generating article, in which the article is physically separate from the aerosol-generating device. In use, a cartridge may hold the aerosol-generating article and the aerosol-generating device may engage with the cartridge. In use, the device may provide power to enable the transfer of heat from a heat source to the aerosol-forming substrate of the aerosol-generating article. During use of such known aerosol-generating devices and aerosol-generating articles, volatile compounds are released from the aerosol-forming substrate by heat transfer from the heat source and entrained in air drawn through the aerosol-generating article. As the released compounds cool, they condense to form an aerosol that is inhaled by the consumer. The present disclosure is concerned with providing an improved cartridge for use with an aerosol-generating device.

During use of some aerosol-generating systems, the cartridges of those systems may reach temperatures at which they are uncomfortably warm to touch. The present disclosure is also concerned with mitigating issues associated with a user touching a cartridge which may be uncomfortably warm to touch.

According to the present disclosure, there is provided a cartridge for use with an aerosol-generating device. The cartridge may be engageable with and disengageable from the device. That is, the cartridge may be reversibly or removably engageable with the device. The cartridge may comprise a mouthpiece. The cartridge may comprise a housing. The housing may comprise a susceptor material. The housing may define a cavity for receiving an aerosol-forming substrate or consumable comprising an aerosol-forming substrate. The cartridge may comprise an ejector. A portion of the ejector may be slideable within the cavity. A portion of the ejector may be slideable within the cavity so as to eject an aerosol-forming substrate or consumable from the cavity.

According to a first aspect of the present disclosure, there is provided a cartridge for use with an aerosol-generating device. The cartridge is engageable with and disengageable from the device. The cartridge comprises a mouthpiece and a housing. The housing comprises a susceptor material and defines a cavity for receiving an aerosol-forming substrate or consumable comprising an aerosol-forming substrate. The cartridge also comprises an ejector, a portion of the ejector being slideable within the cavity so as to eject an aerosol-forming substrate or consumable from the cavity.

In use, a user may insert a consumable comprising an aerosol-forming substrate into the cavity of the cartridge. Then, the user may engage the cartridge with an aerosol-generating device. The device may then inductively heat the susceptor material of the housing to form an aerosol from the aerosol-forming substrate. Whilst this heating occurs, a user may puff on the mouthpiece of the cartridge to draw the aerosol formed into their mouth or lungs.

Advantageously, the cartridge comprising a mouthpiece may mean that a user does not have to puff directly on an aerosol-generating article, or consumable, comprising the aerosol-forming substrate. This may be preferable for some users.

Advantageously, the cartridge housing comprising a susceptor material may mean that the aerosol-forming substrate can be inductively heated. This may be preferable to resistive heating because, in some cases, resistive heating is less efficient due to electrical energy being wasted heating up electrical contacts rather than the resistive heating element.

Advantageously, the ejector may allow a user to eject a consumable comprising the aerosol-forming substrate without having to touch the consumable.

As used herein, the term "aerosol" refers to a dispersion of solid particles, or liquid droplets, or a combination of solid particles and liquid droplets, in a gas. The aerosol may be visible or invisible. The aerosol may include vapours of substances that are ordinarily liquid or solid at room temperature as well as solid particles, or liquid droplets, or a combination of solid particles and liquid droplets.

As used herein, the term "aerosol-forming substrate" refers to a substrate capable of releasing volatile compounds that can form an aerosol. The volatile compounds may be released by heating or combusting the aerosol-forming substrate.

The aerosol-forming substrate may be a solid aerosol-forming substrate. The solid aerosol-forming substrate may comprise one or more of: powder, granules, pellets, shreds, strands, strips or sheets containing one or more of: herb leaf, tobacco leaf, tobacco ribs, expanded tobacco and homogenised tobacco.

The aerosol-forming substrate may comprise solid and liquid components. The aerosol-forming substrate may be a liquid, gel or paste aerosol-forming substrate.

The aerosol-forming substrate may be provided on or embedded in a thermally stable carrier. The carrier may take the form of powder, granules, pellets, shreds, strands, strips or sheets. The solid aerosol-forming substrate may be deposited on the surface of the carrier in the form of, for example, a sheet, foam, gel or slurry. The aerosol-forming substrate may be deposited on the entire surface of the carrier, or alternatively, may be deposited in a pattern in order to provide a non-uniform flavour delivery during use.

The aerosol-forming substrate may comprise nicotine. The aerosol-forming substrate may comprise plant-based material. The aerosol-forming substrate may comprise homogenised plant-based material. The aerosol-forming substrate may comprise tobacco. The aerosol-forming substrate may comprise a tobacco-containing material. The tobacco-containing material may contain volatile tobacco flavour compounds. These compounds may be released from the aerosol-forming substrate upon heating. The aerosol-forming substrate may comprise homogenised tobacco material. The aerosol-forming substrate may comprise other additives and ingredients, such as flavourants.

The aerosol-forming substrate may comprise homogenised tobacco material. As used herein, the term "homogenised tobacco material" refers to a material formed by agglomerating particulate tobacco.

The aerosol-forming substrate may comprise a gathered sheet of homogenised tobacco material. As used herein, the term "sheet" refers to a laminar element having a width and length substantially greater than the thickness thereof. As used herein, the term "gathered" is used to describe a sheet that is convoluted, folded, or otherwise compressed or constricted substantially transversely to the longitudinal axis of the aerosol-generating article.

The aerosol-forming substrate may comprise an aerosol former. As used herein, the term "aerosol former" is used to describe any suitable known compound or mixture of compounds that, in use, facilitates formation of an aerosol and that is substantially resistant to thermal degradation at the operating temperature of the aerosol-generating article. Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as propylene glycol, triethylene glycol, 1,3-butanediol and, most preferred, glycerine.

The aerosol-forming substrate may comprise a single aerosol former. For example, the aerosol-forming substrate may comprise glycerine as the only aerosol former, or propylene glycol as the only aerosol former. Alternatively, the aerosol-forming substrate may comprise a combination of two or more aerosol formers. For example, the aerosol former component of the aerosol-forming substrate may be glycerine and propylene glycol.

As used herein, the term "aerosol-generating article" or "consumable" refers to an article comprising, or consisting of, an aerosol-forming substrate. An aerosol-generating article or consumable may comprise components in addition to the aerosol-forming substrate. The aerosol-generating article or consumable may be a smoking article. The aerosol-generating article or consumable may generate an aerosol that is directly inhalable into a user's lungs through the user's mouth. The aerosol-generating article or consumable may be a smoking article that generates a nicotine-containing aerosol that is directly inhalable into a user's lungs through the user's mouth. The aerosol-generating article or consumable may be in the form of a rod.

As used herein, the term "aerosol-generating device" refers to a device that interacts with an aerosol-forming substrate to generate an aerosol. An aerosol-generating device may interact with an aerosol-generating article comprising an aerosol-forming substrate, or with a cartridge holding an aerosol-forming substrate or aerosol-generating article, to generate an aerosol. The aerosol-generating device may heat the aerosol-forming substrate to facilitate release of volatile compounds from the substrate. The aerosol-generating device may be an electrically operated aerosol-generating device. The aerosol-generating device may comprise an atomiser, such as an electric heater, to heat the aerosol-forming substrate to form an aerosol.

As used herein, the terms "axial" and "longitudinal" are used to describe a direction between a downstream, proximal or mouth end of a component, such as an aerosol-generating device, cartridge or aerosol-generating article, and an opposed, upstream or distal end of the component.

As used herein, the terms "radial" and "transverse" are used to describe a direction perpendicular to the longitudinal direction.

As used herein, the term "length" is used to describe a maximum longitudinal dimension between a distal or upstream end of a component, such as an aerosol-generating device, cartridge or aerosol-generating article, and an opposed, upstream or distal end of the component.

As used herein, the term "width" is used to describe a transverse dimension of a component, such as an aerosol-generating device, cartridge or aerosol-generating article.

As used herein, the term "diameter" is used to describe a maximum transverse dimension of a component, such as an aerosol-generating device, cartridge or aerosol-generating article.

As used herein, the term "heat-activated locking mechanism" is used to refer to a locking mechanism which operates automatically in response to a change in temperature, for example an increase in temperature.

The cartridge housing may define an axial air inlet. The axial air inlet may allow air to flow into the housing in an axial direction. The housing may define an air outlet. The air outlet may be downstream of the axial air inlet. The air outlet may be an axial air outlet. The air outlet may allow air to flow out of the housing in an axial direction. The housing may define a first air flow path from the axial air inlet to the air outlet. Advantageously, the axial air inlet and axial air outlet may allow the cartridge to be used with consumables configured to have axial air flow therethrough, for example a consumable having an impermeable barrier around its circumference but a permeable barrier, or no barrier, at its axial ends.

The housing of the cartridge may have a proximal, or downstream, end and a distal, or upstream, end. The housing may be, or may comprise, a partially or entirely hollow tube. The tube may be defined between a proximal, or downstream, end and a distal, or upstream, end. The tube may define the cavity for receiving the aerosol-forming substrate.

The cartridge cavity may be suitable for receiving a consumable. As stated above, the term "consumable" may refer to an article comprising, or consisting of, an aerosol-forming substrate. The cavity may be suitable for receiving multiple consumables. Advantageously, the ability to hold multiple consumables may allow a user to customise their experience by using multiple consumables of different flavours.

Each consumable may have a length spanning an axial direction between an upstream end and a downstream end. Each consumable may have a diameter spanning a transverse direction. The cavity may be suitable for receiving multiple consumables such that the consumables are arranged axially within the cavity. The cavity may be suitable for receiving multiple consumables such that an upstream end of a first consumable received in the cavity is located adjacent to, and optionally in abutment with, a downstream end of a second consumable received in the cavity. In addition, an upstream end of the second consumable received in the cavity may be located adjacent to, and optionally in abutment with, a downstream end of a third consumable received in the cavity. The cavity may be suitable for receiving multiple consumables such that a first consumable received in the cavity is entirely downstream of a second consumable received in the cavity. In addition, the second consumable received in the cavity may be entirely downstream of a third consumable received in the cavity. Advantageously, allowing this arrangement in the cavity may allow a user to customise their experience by using different orders of consumables of different flavours in the cavity.

The cavity may be configured to securely hold one or more consumables received in the cavity. For example, the cavity may be sized so as to securely hold one or more consumables received in the cavity using an interference fit or friction fit. Advantageously, this may remove the need for a separate mechanism to securely hold consumables in the cavity.

The cartridge housing may define a first radial air inlet. The first radial air inlet may be upstream of the air outlet. The first radial air inlet may be downstream of the axial air inlet. A second air flow path may be defined from the first radial air inlet to the air outlet. The first radial air inlet may allow air to flow into the housing in a radial direction.

The cartridge housing may define a second radial air inlet. The second radial air inlet may be upstream of the air outlet. The second radial air inlet may be axially spaced along the housing from the first radial air inlet. The second radial air inlet may be downstream of the first radial air inlet. A third air flow path may be defined from the second radial air inlet to the air outlet. The second radial air inlet may allow air to flow into the housing in a radial direction.

The cartridge housing may define a third radial air inlet. The third radial air inlet may be upstream of the air outlet. The third radial air inlet may be axially spaced along the housing from the first and second radial air inlets. The third radial air inlet may be downstream of the second radial air inlet. A fourth air flow path may be defined from the third radial air inlet to the air outlet. The third radial air inlet may allow air to flow into the housing in a radial direction.

The first radial air inlet may be positioned so as to align with a first consumable received in the cavity. In use, air may flow through the first radial air inlet then through the first consumable, for example through a permeable outer, or circumferential, portion of the first consumable. The air may then flow axially through the housing. Where a second consumable is received in the cavity, air may flow axially through the second consumable after flowing through the first consumable. Where a third consumable is also received in the cavity, air may flow axially through the third consumable after flowing through the second consumable.

The second radial air inlet may be positioned so as to align with a second consumable received in the cavity. In use, air may flow through the second radial air inlet then through the second consumable, for example through a permeable outer, or circumferential, portion of the second consumable. The air may then flow axially through the housing. Where a third consumable is also received in the cavity, air may flow axially through the third consumable after flowing through the second consumable.

The third radial air inlet may be positioned so as to align with a third consumable received in the cavity. In use, air may flow through the third radial air inlet then through the third consumable, for example through a permeable outer, or circumferential, portion of the third consumable. The air may then flow axially through the housing.

Advantageously, the use of radial air inlets in this manner may enhance the user experience as fresh air may flow through each of the consumables. In contrast, where only an axial air inlet is present, air flowing through the second consumable may not be fresh as this air has already flowed through the first consumable. In this context, the term "fresh air" is used to refer to air which has not already flowed through a consumable.

The cartridge housing may define both an axial air inlet and one or more radial air inlets. For example, the housing may define the axial air inlet and any one, two or all of the first, second and third radial air inlets. Any one, two or all of the first, second and third radial air inlets may be located downstream of the axial air inlet. The air outlet may be downstream of the axial air inlet and the radial air inlet(s). The air flow path from the axial air inlet to the air outlet may merge with any one, two, or all of the air flow path(s) from the first, second or third air inlets to the air outlet. Advantageously, the inclusion of an axial air inlet and a radial air inlet may reduce a resistance to draw of the cartridge by allowing a greater flow rate of air into the housing. Advantageously, this may also allow the cartridge to be used with a greater variety of consumables. This is because the cartridge may be suitable for use with consumables intended for axial air flow therethrough and consumables intended for radial air flow therethrough.

Any one, two or all of the first, second and third radial air inlets may be formed by an air-permeable portion of the housing. Thus, the first radial air inlet may be formed by a first air-permeable portion of the housing. The second radial air inlet may be formed by a second air-permeable portion of the housing. The third radial air inlet may be formed by a third air-permeable portion of the housing.

Any one, two, or all of the first, second and third air-permeable portions of the housing may comprise one or more of a porous material, and a plurality of holes such as a plurality of slits.

Any one, two, or all of the first, second and third air-permeable portions of the housing may have a porosity of between 40% and 95%, or between 50% and 90%, or between 60% and 80%. In this context, the term "porosity" may be used as a measure of free space through a wall of the housing by area. Thus, where an air-permeable portion comprises a plurality of holes surrounded by a solid material, the percentage of the cross-sectional area of the air-permeable portion which is formed by the holes may be between 40% and 95%, or between 50% and 90%, or between 60% and 80% (with the remaining 60% to 5%, or 50% to 10%, or 40% to 20%, being formed by the solid material). Advantageously, these ranges of porosities may provide an optimal comprise between a number of factors, including allowing an appropriate amount of air to flow through the cartridge, allowing a suitable level of heating of the susceptor material of the housing near the air-permeable portions, providing an optimal resistance to draw through the cartridge, and maintaining the structural integrity of the housing.

The first air-permeable portion may comprise a first annular, or substantially annular, air-permeable band in the housing. The first annular, air-permeable band may comprise a first plurality of holes in the housing.

The second air-permeable portion may comprise a second annular, or substantially annular, air-permeable band in the housing. The second annular, air-permeable band may comprise a second plurality of holes in the housing. The second annular air-permeable band may be axially spaced along the housing from the first annular, air-permeable band.

The third air-permeable portion may comprise a third annular, or substantially annular, air-permeable band in the housing. The third annular, air-permeable band may comprise a third plurality of holes in the housing. The third annular air-permeable band may be axially spaced along the housing from the first and second annular, air-permeable bands.

The first air-permeable band may have a first permeability to air flow therethrough. The second air-permeable band may have a second permeability to air flow therethrough. The third air-permeable band may have a third permeability to air flow therethrough. The first permeability may be different to the second permeability. The first permeability may be different to the third permeability. The second permeability may be different to the third permeability. The first air-permeable band, second air-permeable band, and third air-permeable band may all have different permeabilities.

Advantageously, these different permeabilities may allow a user to customise their experience by deciding where to locate consumables in the cartridge based on an expected flow rate of air through the air-permeable bands. For example, where a user wishes to maximise a flavour present in a particular consumable, this consumable may be received in the cavity so as to align with the air-permeable band having the highest permeability.

Any, one, two or all of the first, second and third annular, air-permeable bands of the housing may extend around at least 50, 60, 70, 80, or 90% of the circumference of the housing. Thus, it should be appreciated that the annular, air-permeable bands may, but needn't necessarily, extend around the entire circumference or periphery of the housing.

The cartridge may be useable with an aerosol-generating device configured to inductively heat the susceptor material of the cartridge. For example, the cartridge may be configured to be for use with an aerosol-generating device comprising an inductor, such as an inductor coil. The aerosol-generating device may comprise a power source. The power source may be configured to pass an alternating current through the inductor such that the inductor generates a fluctuating electromagnetic field. The device may be configured such that the cartridge may be located within a fluctuating electromagnetic field. The alternating current may be a high frequency alternating current. This, in turn, may generate eddy currents and hysteresis losses in the susceptor material. This may cause the susceptor material to heat up. Thus, the power source and the inductor may be configured to inductively heat the susceptor material.

The susceptor material may be, or may comprise, any material that can be inductively heated to a temperature sufficient to generate an aerosol from the aerosol-forming substrate. Preferred susceptor materials may be heated to a temperature in excess of 50, 100, 150, 200, 250, 300, 350, or 400 degrees Celsius. Preferred susceptor materials may comprise a metal or carbon or both a metal and carbon. A preferred susceptor material may comprise a ferromagnetic material, for example ferritic iron, or a ferromagnetic steel or stainless steel. A suitable susceptor material may be, or comprise, one or more of graphite, molybdenum, silicon carbide, stainless steels, niobium, and aluminium. Preferred susceptor materials may comprise, or be formed from, 400 series stainless steels, for example grade 410, or grade 420, or grade 430 stainless steel. A particularly preferred susceptor material may be a ferromagnetic alloy, for example a ferromagnetic alloy which does not corrode under operating conditions of the cartridge or system. Different materials will dissipate different amounts of energy when positioned within electromagnetic fields having similar values of frequency and field strength. Thus, parameters of the susceptor material such as material type and size may be altered to provide a desired power dissipation within a known electromagnetic field.

The susceptor material may make up more than 50, 60, 70, or 80% of the housing by weight. The housing may consist of, or be formed from, the susceptor material. Advantageously, a higher proportion of the housing being formed of the susceptor material may lead to greater inductive heating of the housing in an inductively heated aerosol-generating system.

The housing may comprise a housing component. The susceptor material may located on a surface of the housing component, for example an interior surface of the housing component. The susceptor material may be a coating applied to a surface of the housing component, for example an interior surface of the housing component. The susceptor material may define at least a portion of the cavity. Advantageously, the susceptor material being located on an interior surface of the housing component may lead to greater heating of a consumable received in the cavity in use.

The susceptor material may contact the consumable or aerosol-forming substrate in the cavity in use. Advantageously, this may lead to more efficient heat transfer from the susceptor material to the consumable or aerosol-forming substrate in use.

The cavity may have a length of between 20 mm and 100 mm. The cavity may have a length of at least 20, 30, 40 or 50 millimetres. The cavity may have a length of less than 100, 80, or 60 millimetres. The cavity may have a width of between 3 mm and 30 mm. The cavity may have a width of at least 3, 5 or 10 millimetres. The cavity may have a width of less than 30, 20 or 15 millimetres. The cavity may be substantially cylindrical in shape, for example substantially right cylindrical in shape. The cavity may have a circular transverse cross-section, or an oval transverse cross-section, or a polygonal transverse cross-section.

The mouthpiece may be reuseable. The mouthpiece may comprise or be formed from a polymer. The cartridge may be reuseable. Advantageously, a reusable cartridge may be more environmentally friendly than a disposable cartridge.

An air flow path may be defined through the mouthpiece. In use, air may flow through the housing and then through the mouthpiece.

The mouthpiece may comprise a constriction zone, the constriction zone constricting air flow through the mouthpiece in use.

The mouthpiece may comprise an expansion zone downstream of the constriction zone, the expansion zone allowing expansion of the air flow in the mouthpiece in use.

The mouthpiece may comprise a second constriction zone downstream of the expansion zone, the second constriction zone constricting air flow through the mouthpiece in use.

The mouthpiece may comprise a second expansion zone downstream of the second constriction zone, the second expansion zone allowing expansion of the air flow in the mouthpiece in use.

Advantageously, the use of one or more constriction zones, or one or more expansion zones, or one or more constriction zones and one or more expansion zones, in the mouthpiece may be used to enhance mixing of the aerosol prior to delivery to a user. In addition, the use of one or more constriction or expansion zones in the mouthpiece may be used to cool the aerosol prior to delivery to a user.

The ejector may be coupled to the housing of the cartridge. The ejector may be axially slideable relative to the housing. The ejector may be axially slideable relative to the housing from a first axial position on the housing to a second axial position on the housing. The first axial position may be closer to the mouthpiece than the second axial position. The ejector may be slideable from the first axial position to the second axial position so as to eject an aerosol-forming substrate from the cavity.

The ejector may be temporarily securable in one or each of the first axial position and the second axial position. For example, a protrusion on the ejector may snap-fit into a corresponding first recess on the housing in the first axial position. Similarly, the protrusion on the ejector may snap-fit into a corresponding second recess on the housing in the second axial position. Advantageously, this may prevent the ejector sliding freely under the action of gravity.

The ejector may be biased towards one of the first axial position and the second axial position by a biasing means such as a spring.

A second portion of the ejector may be located outside the housing. The ejector may comprise a button portion. The button portion may be located outside the housing. In use, a user may engage the button portion to slide the ejector relative to the housing. Advantageously, this may simplify use of the ejector.

In use, a consumable inserted into the cavity may abut the ejector. For example, a downstream end of a consumable inserted into the cavity may abut the ejector. The ejector may act as a stop for a consumable inserted into the cavity. The ejector may act as the stop in the first axial position. In this sense, the ejector may advantageously be used to position a consumable received in the cavity. For example, the ejector may be used to position the consumable such that the consumable is aligned with a radial inlet, for example first radial air inlet in the housing, or an air-permeable band, for example a first annular, air-permeable band in the housing.

The housing may comprise a slot which extends axially along the housing. The slot may have a width of at least 0.5, 1, or 1.5 millimetres. The slot may have a length of at least 20, 30, or 40 millimetres. The slot may extend along at least 30, 50, or 70% of the length of the housing. The slot may allow a user to determine whether an aerosol-forming substrate may be located inside the cavity of the housing. Advantageously, this may allow a user to determine how many consumables, if any, are received in the cavity without having to use the ejector.

The ejector may be coupled to the slot. The ejector may be slideable in an axial direction along the slot, for example between the first axial position and the second axial position, so as to eject a consumable received in the cavity from the housing.

The cartridge may comprise a mechanical locking component of a heat-activated, mechanical locking mechanism. The locking mechanism may not require any electronics in order to function. The mechanical locking component may activate and deactivate based on the temperature at a portion of the cartridge. Advantageously, this may provide a reliable locking mechanism.

When the cartridge is engaged with the aerosol-generating device, the locking mechanism may be configured to discourage disengagement of the cartridge from the aerosol-generating device if a temperature of a portion of the locking mechanism exceeds a predetermined temperature. Advantageously, this may prevent a user from disengaging the cartridge from the aerosol-generating device whilst a portion of the cartridge is hot.

The locking component may comprise a thermal expansion component, the thermal expansion component being configured to expand or flex when heated. When the cartridge is engaged with the aerosol-generating device, the thermal expansion component may be configured to expand or flex when heated to engage with an engagement component of the aerosol-generating device so as to discourage disengagement of the cartridge from the aerosol-generating device. Advantageously, this may prevent a user from disengaging the cartridge from the aerosol-generating device whilst a portion of the cartridge is hot.

When the cartridge is engaged with the aerosol-generating device, the thermal expansion component may be configured to expand or flex during use of the aerosol-generating device to generate an aerosol.

According to a second aspect of the present disclosure, there is provided an aerosol-generating system. The system comprises an aerosol-generating device and a cartridge. The cartridge may be a cartridge as described above in relation to the first aspect of the present disclosure. Thus, any features described above in relation to the cartridge of the first aspect may be applicable to the cartridge of the system of the second aspect. Similarly, any features described below in relation to the cartridge of the system of the second aspect may be applicable to the cartridge of the first aspect.

The aerosol-generating device may comprise an air inlet. When the cartridge is engaged with the aerosol-generating device, an air flow path may be formed between the air inlet of the device and any one, two, three or all of the air inlets of the cartridge. Thus, in use, air may flow through the air inlet of the device and then through one or more air inlet of the cartridge.

The aerosol-generating device may be configured to inductively heat the susceptor material of the cartridge.

The aerosol-generating device may comprise an inductor, such as an induction coil. The aerosol-generating device may comprise a power source. The power source may be configured to pass an alternating current through the inductor such that the inductor generates a fluctuating or oscillating electromagnetic field.

The alternating current may have any suitable frequency. The alternating current may be a high frequency alternating current. The alternating current may have a frequency between 100 kilohertz (kHz) and 30 megahertz (MHz). Where the inductor is a tubular inductor coil, the alternating current may have a frequency of between 500 kilohertz (kHz) and 30 megahertz (MHz). Where the inductor is a flat inductor coil, the alternating current may have a frequency of between 100 kilohertz (kHz), and 1 megahertz (MHz).

In use, the susceptor material of the cartridge may be located within, or otherwise subjected to, the electromagnetic field generated by the inductor. This may generate eddy currents and hysteresis losses in the susceptor material. This may cause the susceptor material to heat up. Thus, the power source and the inductor may be configured to inductively heat the susceptor material. This may heat a consumable received in the cavity in use, which may consequently generate an aerosol.

The susceptor material may be, or may comprise, any material that can be inductively heated to a temperature sufficient to generate an aerosol from the aerosol-forming substrate. Preferred susceptor materials may be heated to a temperature in excess of 50, 100, 150, 200, 250, 300, 350, or 400 degrees Celsius. Preferred susceptor materials may comprise a metal or carbon or both a metal and carbon. A preferred susceptor material may comprise a ferromagnetic material, for example ferritic iron, or a ferromagnetic steel or stainless steel. A suitable susceptor element may be, or comprise, one or more of graphite, molybdenum, silicon carbide, stainless steels, niobium, and aluminium. Preferred susceptor materials may comprise, or be formed from, 400 series stainless steels, for example grade 410, or grade 420, or grade 430 stainless steel. Different materials will dissipate different amounts of energy when positioned within electromagnetic fields having similar values of frequency and field strength. Thus, parameters of the susceptor material such as material type and size may be altered to provide a desired power dissipation within a known electromagnetic field.

Advantageously, in an aerosol-generating system which uses inductive heating, no electrical contacts need be formed between an electrically resistive heating element and the aerosol-generating device. In addition, inductive heating may provide improved energy conversion compared to resistive heating. This is because inductive heating may not have power losses associated with electrical resistance in connections between an electrically resistive heating element and a power source.

The aerosol-generating device may comprise a chamber for receiving the cartridge. The chamber may extend in an axial direction so as to accommodate at least a portion of a length of the housing of the cartridge.

The device may comprise a first inductor coil. The first inductor coil may be positioned around, or adjacent to, a first portion of the chamber. The aerosol-generating device may comprise a second inductor coil. The second inductor coil may be positioned around, or adjacent to, a second portion of the chamber. The second portion of the chamber may be spaced from the first portion axially along the chamber. Advantageously, the use of two inductor coils axially spaced along the chamber may allow non-uniform heating of the susceptor material(s) of the cartridge. For example, the first and second inductor coils may have different coil thicknesses, coil cross-sectional shapes, coil cross-sectional areas, or different radii of curvature forming the coil, or different alternating currents could be applied to the first and second inductor coils. Adjusting these variables may advantageously allow one to adjust heating of different portions of the cartridge.

As mentioned above in relation to the cartridge of the first aspect, the cavity of the cartridge may be suitable for receiving and positioning a first consumable and a second consumable. The housing of the cartridge may comprise a first portion. The housing of the cartridge may comprise a second portion. The first consumable may be positionable in the first portion of the housing of the cartridge. The second consumable may be positionable in the second portion of the housing of the cartridge. The first portion of the housing of the cartridge may comprise the first radial air inlet or the first air-permeable band. The second portion of the housing of the cartridge may comprise the second radial air inlet or the second air-permeable band.

When the cartridge is received in the chamber, the first portion of the housing of the cartridge may align with the first portion of the chamber. When the cartridge is received in the chamber of the device or when the cartridge is otherwise engaged with the device, the first inductor coil may align with one or both of the first portion of the housing of the cartridge and the first consumable received in the cavity.

When the cartridge is received in the chamber, the second portion of the housing of the cartridge may align with the second portion of the chamber. When the cartridge is received in the chamber of the device or when the cartridge is otherwise engaged with the device, the second coil may align with one or both of the second portion of the housing of the cartridge and the second consumable received in the cavity.

Advantageously, this may allow one to adjust the heating of the first and second consumables individually. For example, this may allow one to heat one of the first and second consumables to a higher temperature than the other consumable by heating susceptor material(s) around that consumable to higher temperature than the susceptor material(s) around the other consumable.

The second inductor coil may be positioned around, or adjacent to, the first portion of the chamber. The second inductor coil may be radially spaced from the first inductor coil. The second inductor coil may at least partially encircle, or at least partially be encircled by, the first inductor coil.

The first inductor coil and the second inductor coil may be independently operable. In use, the device may be able to pass a first alternating current through the first inductor coil simultaneously to passing a second alternating current, different to the first alternating current, through the second inductor coil. The first inductor coil may be electrically connected to a first power source. The second inductor coil may be electrically connected to a second power source. The second power source may be distinct from the first power source. Advantageously, this may allow independent operation of the first and second inductor coils.

According to the present disclosure, there is provided a system comprising a cartridge and a consumable or set of consumables, such as any one, two or all of the first, second and third consumables described above in relation to the first aspect. The cartridge may comprise any of the features of the cartridge of the first aspect. The cartridge may be the cartridge of the first aspect.

The cartridge may be configured to hold at least two consumables, for example by receiving said consumables in the cavity of the cartridge. The cartridge may be configured to hold the first consumable, for example using a friction fit, such that the first consumable aligns with the first radial air inlet, as described above. The cartridge may be configured to hold the second consumable, for example using a friction fit, such that the second consumable aligns with the second radial air inlet, as described above. The cartridge may be configured to hold the third consumable, for example using a friction fit, such that the third consumable aligns with the third radial air inlet, as described above.

According to the present disclosure, there is provided an aerosol-generating system. The aerosol-generating system may comprise any of the features described above in relation to an aerosol-generating system. For example, this system may comprise any of the features of the system according to the second aspect. The system may comprise an aerosol-generating device. The aerosol-generating device may comprise any of the features described above in relation to an aerosol-generating device. The system may comprise a cartridge engageable with and disengageable from the aerosol-generating device. The cartridge may comprise any of the features described above in relation to a cartridge. For example, this cartridge comprise any of the features of the cartridge according to the first aspect. The system may comprise a locking mechanism. The locking mechanism may be a heat-activated locking mechanism. The locking mechanism may be a mechanical locking mechanism. The locking mechanism may be a heat-activated, mechanical locking mechanism. When the cartridge is engaged with the device, the locking mechanism may be configured to discourage disengagement of the cartridge from the aerosol-generating device. When the cartridge is engaged with the device, the locking mechanism may be configured to discourage disengagement of the cartridge from the aerosol-generating device if a temperature of a portion of the locking mechanism exceeds a predetermined temperature.

According to a third aspect of the present disclosure, there is provided an aerosol-generating system. The system comprises an aerosol-generating device and a cartridge engageable with and disengageable from the aerosol-generating device. The system comprises a heat-activated, mechanical locking mechanism. When the cartridge is engaged with the device, the locking mechanism is configured to discourage disengagement of the cartridge from the aerosol-generating device if a temperature of a portion of the locking mechanism exceeds a predetermined temperature.

Advantageously, the locking mechanism may prevent, or at least discourage, a user from disengaging the cartridge from the aerosol-generating device while a portion of the cartridge is still hot. This may reduce the likelihood of a user touching a portion of the cartridge which may be uncomfortably hot to touch.

Advantageously, the locking mechanism being a heat-activated locking mechanism may mean that the locking mechanism is activated automatically in response to heat.

All of the features described above in relation to an aerosol-generating system may be applicable to the aerosol-generating system of the third aspect. For example, the system of the third aspect may comprise any of the features of the system of the second aspect. All of the features described above in relation to an aerosol-generating device may be applicable to the aerosol-generating device of the third aspect. All of the features described above in relation to a cartridge may be applicable to the cartridge of the third aspect. For example, the cartridge of the third aspect may comprise any of the features of the cartridge of the first aspect.

The locking mechanism may not require an electricity to function. The locking mechanism may not comprise any electrical components. The locking mechanism may consist of non-electrical components. Advantageously, this may result in a more reliable locking mechanism.

The locking mechanism may comprise a thermal expansion component. The thermal expansion component may be configured to expand or flex when heated. When the cartridge is engaged with the aerosol-generating device, the thermal expansion component may be heated during use of the device to generate an aerosol. The thermal expansion component may be configured to expand or flex when heated to engage an engagement component. When the cartridge is engaged with the aerosol-generating device, the thermal expansion component may be configured to expand or flex when heated to engage with an engagement component so as to discourage disengagement of the cartridge from the aerosol-generating device. When the cartridge is engaged with the aerosol-generating device, the thermal expansion component may be configured to be heated during use of the device to generate an aerosol so as to expand or flex to engage with an engagement component and discourage disengagement of the cartridge from the aerosol-generating device.

When the cartridge is engaged with the aerosol-generating device, the thermal expansion component may be configured to expand or flex by at least 0.1, 0.5, 1, 2, or 3 mm in a given direction when heated during use of the aerosol-generating device to generate an aerosol. Advantageously, this level of expansion may allow sufficient engagement between the thermal expansion component and the engagement component so as to prevent or strongly discourage a user from disengaging the cartridge from the device during or shortly after use of the device.

The engagement component may be a recess. The recess may be configured to receive at least a portion of the thermal expansion component when the thermal expansion component has expanded. When the cartridge is engaged with the aerosol-generating device, the thermal expansion component may be configured to expand or flex when heated to protrude into, or be received by, the recess. Advantageously, the interaction between a thermal expansion component and a recess may provide a simple and reliable way to discourage disengagement of the cartridge from the aerosol-generating device.

The cartridge may comprise the thermal expansion component. The aerosol-generating device may comprise the thermal expansion component. The cartridge may comprise the engagement component. The aerosol-generating device may comprise the engagement component.

One of the cartridge and the aerosol-generating device may comprise the thermal expansion component, and the other of the cartridge and the aerosol-generating device may comprise the engagement component. Thus, the cartridge may comprise the thermal expansion component and the aerosol-generating device may comprise the engagement component. Alternatively, the aerosol-generating device may comprise the thermal expansion component and the cartridge may comprise the engagement component.

Where the cartridge comprises the engagement component, for example the recess, the engagement component may extend around an entire periphery of the cartridge. Where the device comprises the engagement component, for example the recess, the engagement component may extend around an entire periphery of the cartridge. Advantageously, this may mean that the locking mechanism is operable when the cartridge is engaged with the device, regardless of the orientation of the cartridge relative to the device.

For example, the device may comprise a chamber for receiving at least a portion of the cartridge. The engagement component may be a recess and may extend around an external periphery of the cartridge or an internal periphery of the chamber. The thermal expansion component may be located on the other of the external periphery of the cartridge or the internal periphery of the chamber. Thus, regardless of the orientation of the cartridge relative to the device, when the cartridge is received in the chamber and the thermal expansion component is heated, the thermal expansion component may engage with the engagement component so as to discourage disengagement of the cartridge from the device.

The cartridge and device may be configured such that the cartridge is engageable with the device only in one particular orientation, or in one of a plurality of particular orientations. For example, the cartridge and a chamber of the device may be shaped, or 'keyed', such that the cartridge is receivable in the chamber only in one particular orientation, or in one of a plurality of particular orientations.

When the cartridge is engaged with the aerosol-generating device, the thermal expansion component may be configured to expand during use of the aerosol-generating system to generate an aerosol. Advantageously, this may result in the locking mechanism discouraging disengagement of the cartridge from the device during or shortly after use of the device when the cartridge is still hot from use.

When the cartridge is engaged with the aerosol-generating device, the locking mechanism may be configured to discourage disengagement of the cartridge from the aerosol-generating device if the temperature of a portion of the locking mechanism exceeds a predetermined temperature. The predetermined temperature may be at least 50, 60, or 65 degrees Celsius. The predetermined temperature may be less than 90, 80 or 70 degrees Celsius. The predetermined temperature may be between 60 and 90 degrees Celsius, or between 60 and 70 degrees Celsius, or between 65 and 70 degrees Celsius. Advantageously, this may mean that the locking mechanism is activated during use of the aerosol-generating system to generate an aerosol.

As described with reference to the cartridge of the first aspect, the cartridge may be configured to be inductively heated. The housing of the cartridge may comprise a susceptor material. The thermal expansion component may comprise a susceptor material. The thermal expansion component be configured to be inductively heated. Advantageously, this may ensure that, when the system is being used to generate an aerosol, the thermal expansion component is heated to a temperature sufficient to activate the locking mechanism.

The cartridge may comprise the thermal expansion component. The housing of the cartridge may comprise the thermal expansion component. The thermal expansion component may be located on, or in contact with, the housing of the cartridge. The thermal expansion component may be in thermal contact with the housing of the cartridge. The cartridge may be configured such that, in use, heat from the cartridge, for example the housing of the cartridge, or the susceptor material of the cartridge, is conducted to the thermal expansion component to heat the thermal expansion component. Advantageously, this may provide a reliable way to ensure that the thermal expansion component is heated whenever the housing of the cartridge e is heated. This may reduce the likelihood of the locking mechanism not being activated when the cartridge is heated.

The thermal expansion component may comprise a susceptor material, for example any material or combination of materials listed above with reference to the housing of the cartridge.

The thermal expansion component may comprise a strip of material. The strip of material may be located on an external surface of the cartridge. The strip of material may be located on an internal surface of a chamber of the device. The strip of material may be fixed to the cartridge, or to the device, at two ends. The strip of material may not be fixed to the cartridge, or the device, between the two ends. When heated, the strip of material may be configured to expand and flex or bow outwardly from the external surface of the cartridge, or from the internal surface of the chamber of the device. When heated, a central portion of the strip of material between the two ends may be configured to bow outwardly from the external surface of the cartridge, or from the internal surface of the chamber of the device. When heated, the strip of material may be configured to expand such that a radius of curvature of the strip of material decreases. Advantageously, this arrangement may maximise expansion of the thermal expansion component in a radial direction for a given increase in temperature. This may more securely 'lock' the cartridge in engagement with the device.

The strip of material may comprise a susceptor material, for example any material or combination of materials listed above with reference to the housing of the cartridge. Advantageously, this may allow the strip of material to be inductively heated, for example during use of the system to generate an aerosol.

The thermal expansion component may comprise a material having a linear coefficient of thermal expansion at room temperature greater than 1, 2, 4, 6, 8, 10, 15, or 20 micrometres per metre Kelvin.

The thermal expansion component may comprise a bimetallic part. The bimetallic part may include a first strip of metal located on top of a second strip of metal. The first strip of metal may comprise any of the features of, or may be, the strip of material described above. When heated, the first strip of metal may be configured to expand so as to protrude away from the second strip of metal. Advantageously, this arrangement may maximise the expansion of the thermal expansion component for a given increase in temperature.

The second strip of metal may be part of a housing of the cartridge of the system. The second strip of metal may comprise a susceptor material. The second strip of metal may be inductively heated during use of the aerosol-generating system to generate an aerosol. The first strip of metal may comprise a susceptor material. The first strip of metal may be inductively heated during use of the aerosol-generating system to generate an aerosol. Advantageously, this may mean that the locking mechanism is activated during use of the aerosol-generating system to generate an aerosol.

The first strip of metal may be attached to the second strip of metal at two ends of the first strip of metal. The first strip of metal may not be fixed to the second strip of metal between the two ends of the first strip of metal. When heated, the first strip of metal may be configured to expand and bow outwardly from the second strip of metal. When heated, a central portion of the first strip of metal (a portion between its two ends) may be configured to bow outwardly from the second strip of metal. When heated, the first strip of metal may be configured to expand such that a radius of curvature of a central portion of the first strip of metal decreases. Advantageously, this arrangement may maximise expansion of the thermal expansion component in a radial direction for a given increase in temperature. This may more securely 'lock' the cartridge in engagement with the device.

According to the present disclosure, there is provided a cartridge for use with an aerosol-generating device. The cartridge may be engageable with and disengageable from the aerosol-generating device. The cartridge may comprise a mechanical locking component of a heat-activated, mechanical locking mechanism. When the cartridge is engaged with the device, the locking mechanism may be configured to discourage disengagement of the cartridge from the aerosol-generating device if a temperature of a portion of the locking mechanism exceeds a predetermined temperature.

According to a fourth aspect of the present disclosure, there is provided a cartridge for use with an aerosol-generating device, the cartridge being engageable with and disengageable from the aerosol-generating device. The cartridge comprises a mechanical locking component of a heat-activated, mechanical locking mechanism, wherein, when the cartridge is engaged with the device, the locking mechanism may be configured to discourage disengagement of the cartridge from the aerosol-generating device if a temperature of a portion of the locking mechanism exceeds a predetermined temperature.

Advantageously, the locking mechanism may prevent, or at least discourage, a user from disengaging the cartridge from the aerosol-generating device while a portion of the cartridge is still hot. This may reduce the likelihood of a user touching a portion of the cartridge which may be uncomfortably hot to touch.

Advantageously, the locking mechanism being a heat-activated locking mechanism may mean that the locking mechanism is activated automatically in response to heat.

All of the features described above in relation to a cartridge may be applicable to the cartridge of the fourth aspect. For example, the cartridge of the fourth aspect may comprise any of the features of the cartridge of the first aspect, and any of the features of the cartridge of the system of the third aspect. The cartridge may be the cartridge of the system of the third aspect.

The locking mechanism may not require an electricity to function. The locking mechanism may not comprise any electrical components. The locking mechanism may consist of non-electrical components. Advantageously, this may result in a more reliable locking mechanism.

The mechanical locking component may comprise, or may be, the thermal expansion component. The mechanical locking component may comprise, or may be, the engagement component.

Where the mechanical locking component comprises, or is, the thermal expansion component, the locking component may be configured to engage with the engagement component of the device, for example as described with reference to the third aspect. Where the mechanical locking component comprises, or is, the engagement component, the locking component may be configured to engage with the thermal expansion component of the device, for example as described with reference to the third aspect.

According to the present disclosure, there is provided an aerosol-generating device. The device may be configured to engage with and disengage from a cartridge, for example the cartridge of the fourth aspect. The device may comprise a mechanical locking component of a heat-activated, mechanical locking mechanism. When the cartridge is engaged with the device, the locking mechanism may be configured to discourage disengagement of the cartridge from the aerosol-generating device if a temperature of a portion of the locking mechanism exceeds a predetermined temperature.

According to a fifth aspect of the present disclosure, there is provided an aerosol-generating device. The device is configured to engage with and disengage from a cartridge, for example the cartridge of the fourth aspect. The device comprises a mechanical locking component of a heat-activated, mechanical locking mechanism. When the cartridge is engaged with the device, the locking mechanism is configured to discourage disengagement of the cartridge from the aerosol-generating device if a temperature of a portion of the locking mechanism exceeds a predetermined temperature.

Advantageously, the locking mechanism may prevent, or at least discourage, a user from disengaging the cartridge from the aerosol-generating device while a portion of the cartridge is still hot. This may reduce the likelihood of a user touching a portion of the cartridge which may be uncomfortably hot to touch.

Advantageously, the locking mechanism being a heat-activated locking mechanism may mean that the locking mechanism is activated automatically in response to heat.

All of the features described above in relation to an aerosol-generating device may be applicable to the aerosol-generating device of the fifth aspect. For example, the aerosol-generating device of the fifth aspect may comprise any of the features of the aerosol-generating device of the system of the third aspect. The aerosol-generating device of the fifth aspect may be the aerosol-generating device of the system of the third aspect.

The locking mechanism may not require an electricity to function. The locking mechanism may not comprise any electrical components. The locking mechanism may consist of non-electrical components. Advantageously, this may result in a more reliable locking mechanism.

The mechanical locking component may comprise, or may be, the thermal expansion component. The mechanical locking component may comprise, or may be, the engagement component.

Where the mechanical locking component comprises, or is, the thermal expansion component, the locking component may be configured to engage with the engagement component of the cartridge, for example as described with reference to the third aspect. Where the mechanical locking component comprises, or is, the engagement component, the locking component may be configured to engage with the thermal expansion component of the cartridge, for example as described with reference to the third aspect.

The invention is defined in the claims. However, below there is provided a non-exhaustive list of non-limiting examples. Any one or more of the features of these examples may be combined with any one or more features of another example, embodiment, or aspect described herein.

Example Ex1. A cartridge for use with an aerosol-generating device, the cartridge being engageable with and disengageable from the device, the cartridge comprising:

a mouthpiece;

a housing comprising a susceptor material, the housing defining a cavity for receiving an aerosol-forming substrate; and an ejector, a portion of the ejector being slideable within the cavity so as to eject an aerosol-forming substrate from the cavity.

Example Ex2. A cartridge according to example Ex1, wherein the housing defines an axial air inlet and an air outlet downstream of the axial air inlet, and a first air flow path is defined from the axial air inlet to the air outlet.

Example Ex3. A cartridge according to example Ex1, wherein the housing defines a first radial air inlet and an air outlet downstream of the radial air inlet, and a second air flow path is defined from the radial air inlet to the air outlet.

Example Ex4. A cartridge according to example Ex1, wherein the housing defines an axial air inlet, a first radial air inlet, and an air outlet downstream of the axial air inlet and the first radial air inlet, wherein a first air flow path is defined from the axial air inlet to the air outlet and a second air flow path is defined from the first radial air inlet to the air outlet.

Example Ex5. A cartridge according to example Ex4, wherein the first radial air inlet is located downstream of the axial air inlet.

Example Ex6. A cartridge according to any of examples Ex3, Ex4, or Ex5, wherein the first radial air inlet is formed by a first air-permeable portion of the housing.

Example Ex7. A cartridge according to example Ex6, wherein the first air-permeable portion of the housing comprises one or more of a porous material, a plurality of slits, and a plurality of holes.

Example Ex8. A cartridge according to example Ex7, wherein the first air-permeable portion of the housing has a porosity of between 40% and 95%.

Example Ex9. A cartridge according to any of examples Ex3 to Ex8, wherein the housing defines a second radial air inlet, the second radial air inlet being spaced from the first radial air inlet axially along the housing.

Example Ex10. A cartridge according to any of examples Ex3 to Ex9, wherein the first radial air inlet comprises a first plurality of holes forming a first annular, air-permeable band in the housing.

Example Ex11. A cartridge according to example Ex9, wherein the first radial air inlet comprises a first plurality of holes forming a first annular, air-permeable band in the housing and the second radial air inlet comprises a second plurality of holes forming a second annular, air-permeable band in the housing, the second annular, air-permeable band being spaced axially along the housing from the first air-permeable band.

Example Ex12. A cartridge according to example Ex11, wherein the first air-permeable band has a first permeability to air flow therethrough, and the second air-permeable band has a second permeability to air flow therethrough, wherein the first permeability is different to the second permeability.

Example Ex13. A cartridge according to any preceding example, wherein the housing is formed of the susceptor material.

Example Ex14. A cartridge according to any preceding example, wherein the housing comprises a housing component and the susceptor material is a coating applied to a surface of the housing component.

Example Ex15. A cartridge according to example Ex14, wherein the coating is applied to an interior surface of the housing component and the coating defines at least a portion of the cavity.

Example Ex16. A cartridge according to any preceding example, wherein the susceptor material contacts the aerosol-forming substrate in the cavity in use.

Example Ex17. A cartridge according to any preceding example, wherein the susceptor material is, or comprises, one or more of iron, steel and aluminium.

Example Ex18. A cartridge according to any preceding example, wherein the cavity has a length of at least 20, 30, 40, or 50 millimetres.

Example Ex19. A cartridge according to any preceding example, wherein the cavity has a length of less than 100, 80, or 60 millimetres.

Example Ex20. A cartridge according to any preceding example, wherein the cavity has a width of at least 3, 5, or 10 millimetres.

Example Ex21. A cartridge according to any preceding example, wherein the cavity has a width of less than 30, 20, or 15 millimetres.

Example Ex22. A cartridge according to any preceding example, wherein the cavity is substantially a right cylinder in shape.

Example Ex23. A cartridge according to any preceding example, wherein an air flow path is defined through the mouthpiece such that, in use, air flows through the housing and then through the mouthpiece.

Example Ex24. A cartridge according to example Ex23, wherein the mouthpiece comprises a constriction zone, the constriction zone constricting air flow through the mouthpiece in use.

Example Ex25. A cartridge according to example Ex24, wherein the mouthpiece comprises an expansion zone downstream of the constriction zone, the expansion zone allowing expansion of the air flow in the mouthpiece in use.

Example Ex26. A cartridge according to example Ex25, wherein the mouthpiece comprises a second constriction zone downstream of the expansion zone, the second constriction zone constricting air flow through the mouthpiece in use.

Example Ex27. A cartridge according to example Ex26, wherein the mouthpiece comprises a second expansion zone downstream of the second constriction zone, the second expansion zone allowing expansion of the air flow in the mouthpiece in use.

Example Ex28. A cartridge according to any preceding example, wherein the ejector is coupled to the housing.

Example Ex29. A cartridge according to any preceding example, wherein the ejector axially slideable from a first axial position on the housing to a second axial position on the housing.

Example Ex30. A cartridge according to example Ex29, wherein the ejector is slideable from the first axial position to the second axial position so as to eject an aerosol-forming substrate from the cavity.

Example Ex31. A cartridge according to any preceding example, wherein, in use, the ejector acts as a stop for an aerosol-forming substrate inserted into the cavity.

Example Ex32. A cartridge according to examples Ex29 or Ex30, wherein, in use, the ejector acts as a stop in the first axial position for an aerosol-forming substrate inserted into the cavity.

Example Ex33. A cartridge according to any preceding example, wherein a second portion of the ejector is located outside the housing.

Example Ex34. A cartridge according to any preceding example, wherein the housing comprises a slot which extends axially along the housing.

Example Ex35. A cartridge according to example Ex34, wherein the slot has a width of at least 0.5 millimetres.

Example Ex36. A cartridge according to examples Ex34 or Ex35, wherein the slot has a length of at least 20 millimetres.

Example Ex37. A cartridge according to any of examples Ex34 to Ex36, wherein the slot extends at least 50% of a length of the housing.

Example Ex38. A cartridge according to any of examples Ex34 to Ex37, wherein the slot is for allowing a user to determine whether an aerosol-forming substrate is located inside the cavity of the housing.

Example Ex39. A cartridge according to any of examples Ex34 to Ex38, wherein the ejector is coupled to the slot.

Example Ex40. A cartridge according to example Ex39, wherein the ejector is slideable in an axial direction along the slot.

Example Ex41. A cartridge according to any preceding example, wherein the cartridge comprises a locking component of a heat-activated, mechanical locking mechanism.

Example Ex42. A cartridge according to example Ex41, wherein, when the cartridge is engaged with the aerosol-generating device, the locking mechanism is configured to discourage disengagement of the cartridge from the aerosol-generating device if a temperature of a portion of the locking mechanism exceeds a predetermined temperature.

Example Ex43. A cartridge according to examples Ex41 or Ex42, wherein the locking component comprises a thermal expansion component, the thermal expansion component being configured to expand when heated.

Example Ex44. A cartridge according to example Ex43, wherein, when the cartridge is engaged with the aerosol-generating device, the thermal expansion component is configured to expand when heated to engage with an engagement component of the aerosol-generating device so as to discourage disengagement of the cartridge from the aerosol-generating device.

Example Ex45. A cartridge according to examples Ex43 or Ex44, wherein, when the cartridge is engaged with the aerosol-generating device, the thermal expansion component is configured to expand during use of the aerosol-generating device to generate an aerosol.

Example Ex46. An aerosol-generating system comprising an aerosol-generating device and a cartridge according to any preceding example.

Example Ex47. An aerosol-generating system according to example Ex46, wherein the aerosol-generating device is configured to inductively heat the susceptor material of the cartridge.

Example Ex48. An aerosol-generating system according to example Ex47, wherein the aerosol-generating device comprises a chamber for receiving the cartridge, and a first inductor coil positioned around a first portion of the chamber.

Example Ex49. An aerosol-generating system according to example Ex48, wherein the aerosol-generating device comprises a second inductor coil.

Example Ex50. An aerosol-generating system according to example Ex49, wherein the second inductor coil is positioned around a second portion of the chamber, the second portion of the chamber being spaced from the first portion axially along the chamber.

Example Ex51. An aerosol-generating system according to example Ex50, wherein the cavity of the cartridge is for receiving and positioning a first aerosol-forming substrate and a second aerosol-forming substrate such that, when the cartridge is received in the chamber of the device, the first inductor coil is substantially aligned with the first aerosol-forming substrate and the second coil is substantially aligned with the second aerosol-forming substrate.

Example Ex52. An aerosol-generating system according to example Ex51, wherein the housing of the cartridge defines a first radial air inlet and a second radial air inlet, the second radial air inlet being spaced from the radial air inlet axially along the housing such that, when the cartridge is received in the chamber of the device, the first inductor coil is substantially aligned with the first radial air inlet and the second coil is substantially aligned with the second radial air inlet.

Example Ex53. An aerosol-generating system according to example Ex49, wherein the second inductor coil is positioned around the first portion of the chamber.

Example Ex54. An aerosol-generating system according to example Ex53, wherein the second inductor coil is radially spaced from the first inductor coil.

Example Ex55. An aerosol-generating system according to any of examples Ex49 to Ex54, wherein the first inductor coil and second inductor coil are independently operable, for example wherein the first inductor coil is electrically connected to a first power source and the second inductor coil is electrically connected to a second power source distinct from the first power source.

Example Ex56. An aerosol-generating system comprising an aerosol-generating device and a cartridge engageable with and disengageable from the aerosol-generating device, the system comprising:

a heat-activated, mechanical locking mechanism, wherein, when the cartridge is engaged with the device, the locking mechanism is configured to discourage disengagement of the cartridge from the aerosol-generating device if a temperature of a portion of the locking mechanism exceeds a predetermined temperature.

Example Ex57. An aerosol-generating system according to example Ex56, wherein the locking mechanism comprises a thermal expansion component, the thermal expansion component being configured to expand when heated.

Example Ex58. An aerosol-generating system according to example Ex57, wherein, when the cartridge is engaged with the aerosol-generating device, the thermal expansion component is configured to expand when heated to engage with an engagement component so as to discourage disengagement of the cartridge from the aerosol-generating device.

Example Ex59. An aerosol-generating system according to example Ex58, wherein the engagement component is a recess and, when the cartridge is engaged with the aerosol-generating device, the recess is configured to receive a portion of the thermal expansion component when the thermal expansion component has expanded.

Example Ex60. An aerosol-generating system according to examples Ex58 or Ex59, wherein the thermal expansion component is located on one of the cartridge and the aerosol-generating device, and the engagement component is located on the other of the cartridge and the aerosol-generating device.

Example Ex61. An aerosol-generating system according to any of examples Ex57 to Ex60, wherein, when the cartridge is engaged with the aerosol-generating device, the thermal expansion component is configured to expand during use of the aerosol-generating system to generate an aerosol.

Example Ex62. An aerosol-generating system according to any of examples Ex56 to Ex61, wherein, when the cartridge is engaged with the aerosol-generating device, the locking mechanism is configured to discourage disengagement of the cartridge from the aerosol-generating device if the temperature of the portion of the locking mechanism exceeds a temperature of 50, 60, 65, or 70 degrees Celsius.

Example Ex63. An aerosol-generating system according to any of examples Ex57 to Ex62, wherein the thermal expansion component comprises a metal.

Example Ex64. An aerosol-generating system according to example Ex63, wherein the thermal expansion component comprises a bimetallic part.

Example Ex65. An aerosol-generating system according to example Ex64, wherein the bimetallic part includes a first strip of metal located on top of a second strip of metal.

Example Ex66. An aerosol-generating system according to example Ex65, wherein, when heated, the first strip of metal is configured to expand so as to protrude away from the second strip of metal, and optionally to form or increase the size of a space between a portion of the first strip of metal and the second strip of metal.

Example Ex67. An aerosol-generating system according to examples Ex65 or Ex66, wherein the second strip of metal is part of a housing of the cartridge of the system.

Example Ex68. An aerosol-generating system according to example Ex67, wherein one or both of the first strip of metal and the second strip of metal comprise a susceptor material.

Example Ex69. An aerosol-generating system according to example Ex68, wherein one or both of the first strip of metal and the second strip of metal are inductively heated during use of the aerosol-generating system to generate an aerosol.

Example Ex70. A cartridge for use with an aerosol-generating device, the cartridge being engageable with and disengageable from the aerosol-generating device, the cartridge comprising:

a mechanical locking component of a heat-activated, mechanical locking mechanism, wherein, when the cartridge is engaged with the device, the locking mechanism is configured to discourage disengagement of the cartridge from the aerosol-generating device if a temperature of a portion of the locking mechanism exceeds a predetermined temperature such as 50, 60, 65 or 70 degrees Celsius.

Example Ex71. An aerosol-generating device, the device being configured to engage with and disengage from a cartridge, the device comprising:

a mechanical locking component of a heat-activated, mechanical locking mechanism, wherein, when the cartridge is engaged with the device, the locking mechanism is configured to discourage disengagement of the cartridge from the aerosol-generating device if a temperature of a portion of the locking mechanism exceeds a predetermined temperature such as 50, 60, 65 or 70 degrees Celsius.

Examples will now be further described with reference to the figures in which.

Figure 1:
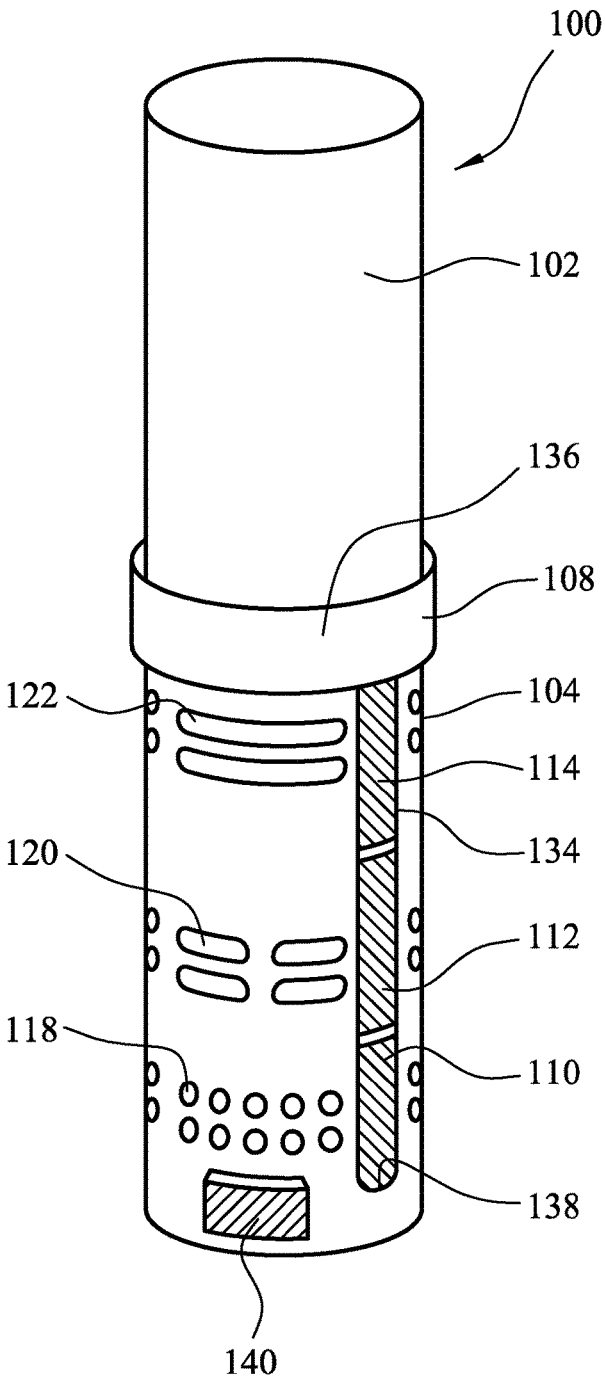
FIG. 1 shows a perspective view of a cartridge for use with an aerosol-generating device.
Figure 2:
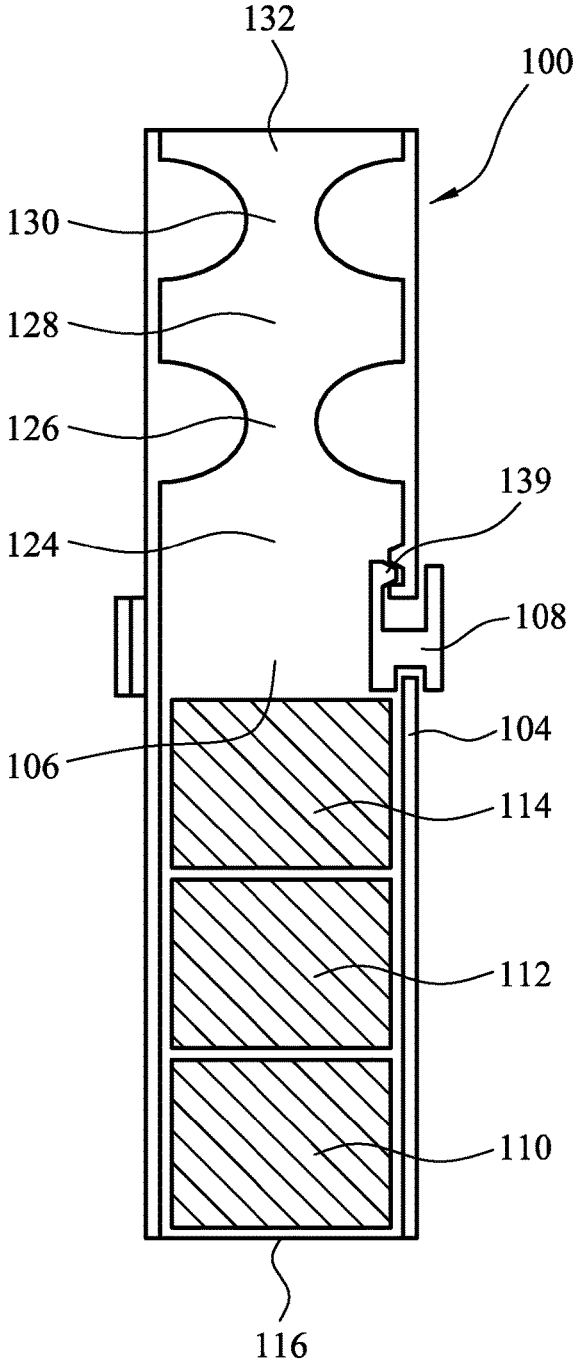
FIG. 2 shows a cross-sectional view of the cartridge of FIG. 1.

FIGS. 1 and 2 show a perspective view and a cross-sectional view, respectively, of a cartridge 100 for use with an aerosol-generating device. The cartridge 100 is engageable with and disengageable from an aerosol-generating device. The cartridge 100 comprises a reusable mouthpiece 102 formed of a polymeric material. The cartridge 100 also comprises a housing 104 formed from a susceptor material. In the specific embodiment the susceptor material may be a stainless steel. The housing 104 defines a cavity 106 for receiving a consumable or aerosol-forming substrate. The cartridge 100 also comprises an ejector 108. A portion of the ejector 108 is slideable within the cavity 106 so as to eject an aerosol-forming substrate from the cavity 106.

The cavity 106 is able to receive more than one consumable. In FIG. 2, the cartridge 100 is shown with a first consumable 110, a second consumable 112, and a third consumable 114 received in the cavity 106. Each consumable comprises an aerosol-forming substrate. One or more of the consumables may also comprise flavourants and the like.

The housing 104 is in the form of an open-ended tube. The housing 104 comprises an axial air inlet 116, a first radial air inlet 118, a second radial air inlet 120 and a third radial air inlet 122. The housing 104 also defines an axial air outlet 124 in fluid communication with the mouthpiece 102.

In use, a user inserts the desired consumables into the cavity 106. These consumables are held in the cavity 106 using a friction, or interference, fit. The cartridge is then engaged with an aerosol-generating device. Specifically, the cartridge 100 is received in a chamber of an aerosol-generating device and the susceptor material of the housing is inductively heated by the aerosol-generating device as the user inhales on the mouthpiece 102. The heating of the susceptor material heats the consumables 110, 112, 114 so as to produce an aerosol. Air flows in through an air inlet of the aerosol-generating device, then through the axial air inlet 116 and each of the first, second and third radial air inlets 118, 120, 122 of the cartridge 100. This air flows through the consumables and carries the aerosol formed from heating the consumables to the air outlet 124 of the housing 104, and then through the mouthpiece 102 to be delivered to the user.

The first radial air inlet 118 is formed by a first air-permeable portion of the housing. The first air-permeable portion of the housing comprises a plurality of holes. This plurality of holes forms a first, annular, air-permeable band in the housing. The first air-permeable portion of the housing has a porosity of around 50%. That is, approximately 50% of the cross-section of the first, annular, air-permeable band is made up by the solid material of the housing, and approximately 50% is made up by the holes.

The second radial air inlet 120 is spaced axially along the housing 104 from the first radial air inlet 118. The second radial air inlet 120 is effectively located downstream of the first radial air inlet 118. That is, when considering the axial air flow path through the housing from the axial air inlet 116 to the axial air outlet 124, air flow through the second radial air inlet 120 joins this axial air flow path downstream from where air flow through the first radial air inlet 118 joins this axial air flow path. The second radial air inlet 120 is formed by a second air-permeable portion of the housing. The second air-permeable portion of the housing comprises a plurality of slits. This plurality of slits forms a second, annular, air-permeable band in the housing. The second air-permeable portion of the housing has a porosity of around 65%.

The third radial air inlet 122 is spaced axially along the housing 104 from the second radial air inlet 120. The third radial air inlet 122 is effectively located downstream of the second radial air inlet 120. The third radial air inlet 122 is formed by a third air-permeable portion of the housing. The third air-permeable portion of the housing comprises a plurality of slits. This plurality of slits forms a third, annular, air-permeable band in the housing. The third air-permeable portion of the housing has a porosity of around 80%.

The different porosities of the first, second and third annular, air-permeable bands give the first, second and third annular, air-permeable bands different permeabilities to air flow therethrough in use. In this embodiment, the different permeabilities are created using different shaped holes and slits, though the different permeabilities could equally be created by adjusting the number of, and spacing between the holes or slits in the air-permeable bands.

The housing 104 is formed of a susceptor material. In this embodiment, the housing is formed of a stainless steel, though any suitable susceptor material could be used.

The cavity 106 is substantially a right circular cylinder in shape and has a length of around 50 millimetres and a diameter, or width, of around 15 millimetres An air flow path is defined through the mouthpiece 102 such that, in use, air flows through the housing 104 and then through the mouthpiece 102. The mouthpiece comprises a first constriction zone 126, a first expansion zone 128 downstream of the first constriction zone 126, a second constriction zone 130 downstream of the first expansion zone 128, and a second expansion zone 132 downstream of the second constriction zone 130. In use, the constriction zones 126, 130 constrict air flow through the mouthpiece 102 and the expansion zones 128, 132 allow expansion of air flow in the mouthpiece 102. The constriction and expansion zones help to mix and cool the aerosol before it is delivered to the user.

The ejector 108 is coupled to the housing 104. Specifically, the ejector 108 is coupled to a slot 134 which extends axially along the housing 104. The ejector 108 is axially slideable from a first axial position 136 on the housing 104, where it is shown in FIGS. 1 and 2, to a second axial position 138 on the housing 104 so as to eject any consumable(s) received in the cavity 106 from the cavity 106 without requiring a user to touch the consumable(s). A portion of the ejector 108 is located outside the housing 104 such that a user can easily slide the ejector 108 between these positions.

As shown in FIG. 2, the ejector 108 acts as a stop in the first axial position 136 for a consumable first received in the cavity 106. In this case, the consumable first received in the cavity 106 is the third consumable 114. In this manner, the ejector 108 aligns the third consumable 114 with the third radial air inlet 122. As can be seen in FIG. 2, the ejector 108 can be temporarily secured in the first axial position 136 using a snap fit mechanism 139.

The slot 134 has a width of 1 millimetre and a length of around 20 millimetres. The slot 134 not only provides a path for the ejector 108 to slide along, but also allows a user to view how many consumables are located inside the cavity 106 of the housing 104.

The cartridge 100 also comprises a locking component 140 of a heat-activated, mechanical locking mechanism.

The locking component 140 is a thermal expansion component configured to expand when heated. In this embodiment, the locking component 140 is a bimetallic part comprising a first strip of steel located on top of a second strip of steel. In this context, "on top of" refers to the first strip of steel being located radially outward of the second strip of steel. In this embodiment, the second strip of steel is simply part of the housing 104 of the cartridge 100. The first strip of steel is attached to the second strip of steel (attached to the housing 104) only at its radial ends (the left and right sides of the strip as shown in FIG. 1). Thus, when heated, the first strip of steel is configured to expand so as to protrude away, or bow outwardly, from the second strip of steel such that a space is formed between a central section of the first strip of steel and the second strip of steel. Since the first and second strips are formed from a susceptor material, steel, both of these strips are capable of being inductively heated, for example during use of an aerosol-generating device configured to inductively heat the housing of the cartridge 100.

Operation of the heat-activated locking mechanism of the aerosol-generating system is explained in more detail with reference to FIGS. 4, 5 and 6.

Figure 3:
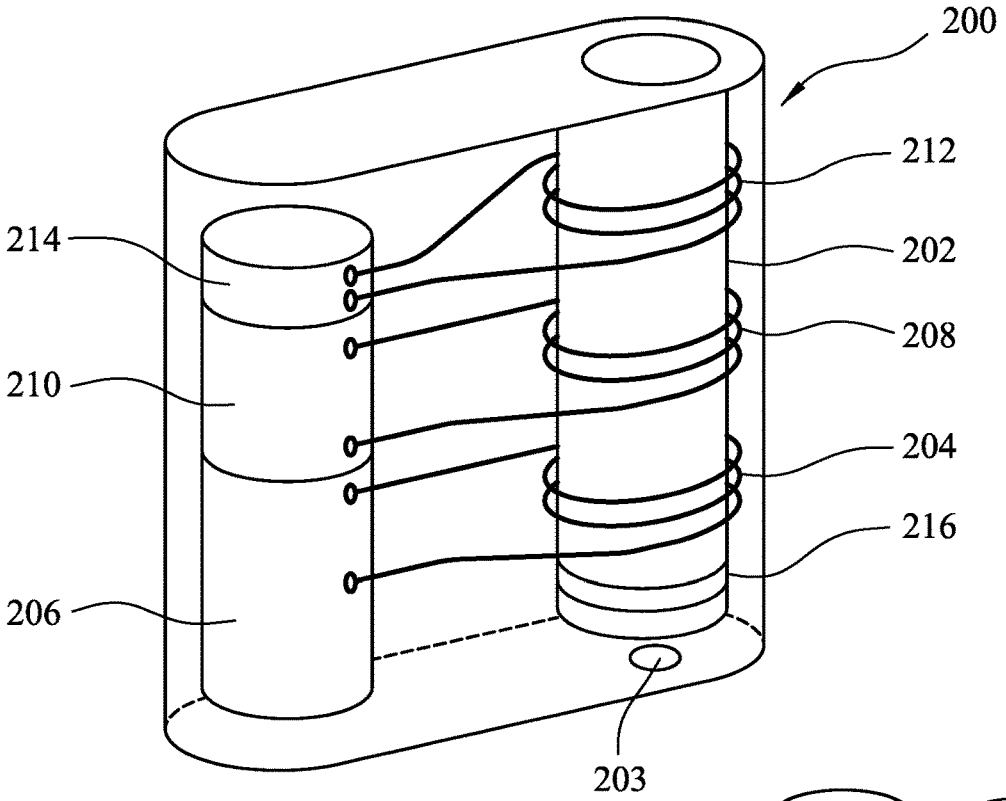
FIG. 3 shows a perspective view of the aerosol-generating device for use with the cartridge of FIG. 1, the view showing internal components of the device.

FIG. 3 shows a perspective view of an aerosol-generating device 200, the view showing internal components of the device 200.

The aerosol-generating device 200 is configured to inductively heat the susceptor material of the cartridge 100. The device 200 comprises a chamber 202 for receiving the cartridge 100. The device 200 also comprises a device air inlet 203 in fluid communication with the chamber 202.

The device 200 comprises a first inductor coil 204 coupled to a first power source 206 and positioned around a first portion of the chamber 202. When the cartridge 100 is received in the chamber 202, the first inductor coil 204, the first consumable 110, and the first radial air inlet 118 are all aligned. Thus, the first inductor coil 204 is predominantly configured to heat the susceptor material of the housing 104 of the cartridge 100 around or near to the first consumable 110.

The device 200 comprises a second inductor coil 208 coupled to a second power source 210 and positioned around a second portion of the chamber 202 axially spaced along the chamber 202 from the first portion of the chamber 202. When the cartridge 100 is received in the chamber 202, the second inductor coil 208, the second consumable 112, and the second radial air inlet 120 are all aligned. Thus, the second inductor coil 208 is predominantly configured to heat the susceptor material of the housing 104 of the cartridge 100 around or near to the second consumable 112.

The device 200 comprises a third inductor coil 212 coupled to a third power source 214 and positioned around a third portion of the chamber 202 axially spaced along the chamber 202 from the first and second portions of the chamber 202. When the cartridge 100 is received in the chamber 202, the third inductor coil 210, the third consumable 114, and the third radial air inlet 122 are all aligned. Thus, the third inductor coil 212 is predominantly configured to heat the susceptor material of the housing 104 of the cartridge 100 around or near to the third consumable 114.

Each of the first, second, and third inductor coils 204, 208, 212 being coupled to their own, respective first, second and third power sources 206, 210, 214 means that different alternating currents can be independently passed through each of these inductor coils. This may allow one to adjust the heating of the first, second and third consumables 110, 112, 114 independently.

The device 200 also comprises an engagement component 216. The engagement component 216 is an annular recess formed on the inside of the chamber 202. The engagement component 216 is part of the heat-activated locking mechanism and is configured to engage with the locking component 140 of the cartridge 100 in use. In particular, the engagement component 216, or recess, is configured to receive the locking component 140 when the locking component 140 is heated to a sufficient temperature so as to expand. Specifically, the first strip of steel of the locking component 140 is received in the recess when heated so as to expand to bow outwardly from the second strip of steel of the locking component 140.

Figure 4:
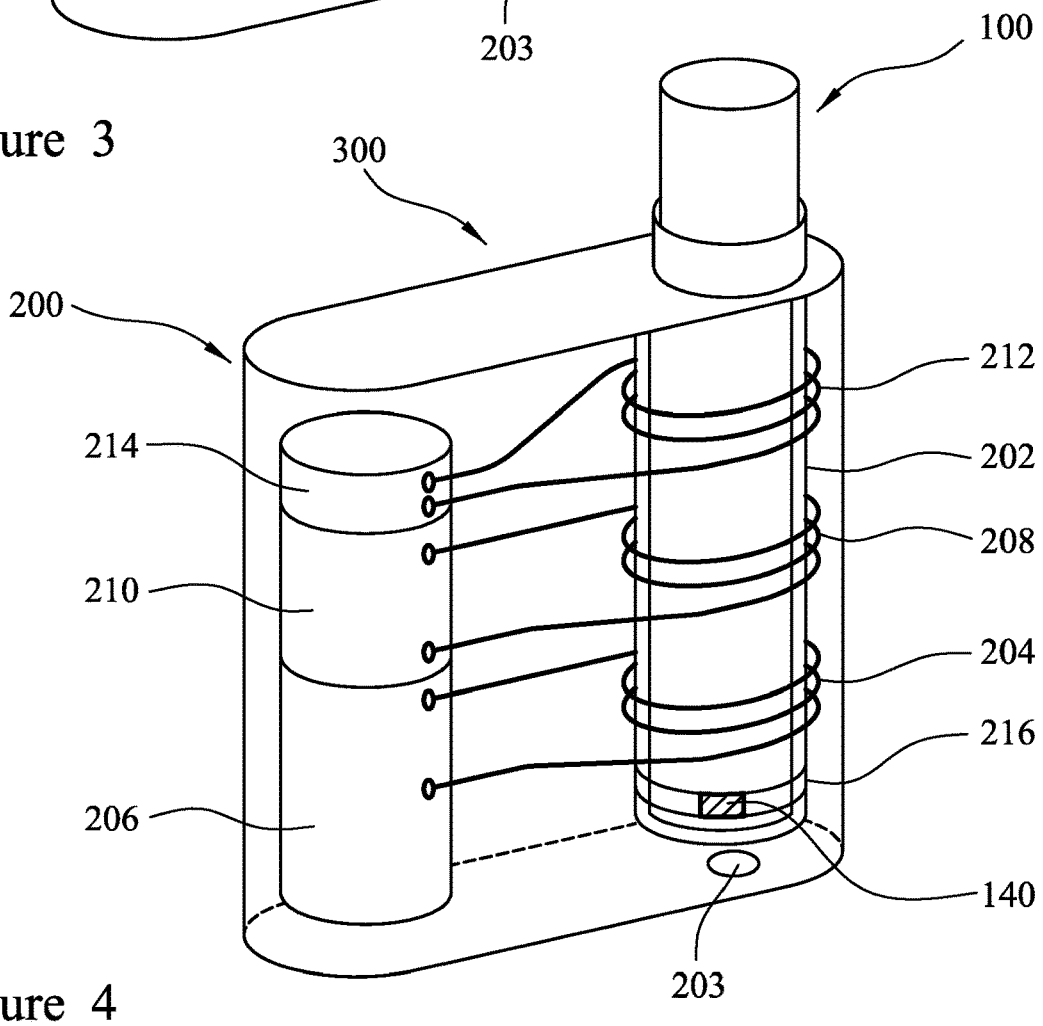
FIG. 4 shows a perspective view of an aerosol-generating system comprising the cartridge of FIGS. 1 and 2 and the device of FIG. 3, the view showing internal components of the system.

FIG. 4 shows a perspective view of an aerosol-generating system 300, the view showing internal components of the system 300. The system 300 shows the cartridge 100 of FIGS. 1 and 2 engaged with the device 200 of FIG. 3. For clarity, the radial air inlets 118, 120, 122 and the slot 134 of the cartridge 100 are not shown in FIG. 4.

The heat-activated locking mechanism of the system 300 comprises the locking component 140 of the cartridge 100 and the engagement component 216 of the device 200. When the cartridge 100 is engaged with the device 200, as shown in FIG. 4, the locking component 140 aligns with the engagement component 216.

In use, after engaging the cartridge 100 with the device 200, a user interface (not shown) such as a button or a touch screen on the device is used to activate the device 200. This causes a controller (not shown) to send a signal to each of the first, second and third power sources 206, 210, 214 to supply high frequency alternating currents to their respective first, second and third inductor coils 204, 208, 212. This causes each inductor coil to generate a fluctuating electromagnetic field. This, in turn, generates eddy currents and hysteresis losses in the susceptor material of the housing 104 of the cartridge 100. This causes the susceptor material to heat up. Thus, the housing 104 is inductively heated. This heat is passed to the first, second and third consumables 110, 112, 114 received in the cavity 106 of the cartridge 100, resulting in the aerosol-forming substrate of each consumable releasing volatile compounds.

Whilst the housing 104 of the cartridge is being inductively heated, the user places their lips on the mouthpiece 102 of the cartridge 100 and inhales. This results in a pressure differential which causes air to flow in through the device air inlet 203 and into the chamber 202 of the device. This air then flows through the axial air inlet 116 and the first, second and third radial air inlets 118, 120, 122 of the cartridge 100. Some air will also flow through the slot 134 of the cartridge 100. This air flows through the consumables and entrains the volatile compounds released by the consumables to form an aerosol. The aerosol flows in a generally axial direction through the housing 104 of the cartridge 100 until reaching the air outlet 124 of the housing 104 and into the mouthpiece 102.

The aerosol then flows through the first and second constriction and expansion zones 126, 128, 130, 132 in the mouthpiece 102. This mixes and cools the aerosol. The aerosol is then delivered to the user, who inhales the aerosol into their mouth and lungs.

Whilst the housing 104 of the cartridge 100 is inductively heated (so as to generate an aerosol), the locking component 140, or thermal expansion component, is also heated. This is partially through conduction of heat from the housing 104 to the locking component 140, and partially through inductive heating of the locking component 140 itself. This is because, in this embodiment, the locking component 140 comprises a susceptor material—steel. This heating of the locking component 140 causes the locking component 140 to expand. Specifically, the first strip of steel of the locking component 140, which is attached to the second strip of steel of the locking component 140 at its radial ends, expands so as to bow outwardly away from the second strip of steel of the locking component 140. This expansion is best shown in FIGS. 5 and 6.

Figure 5:
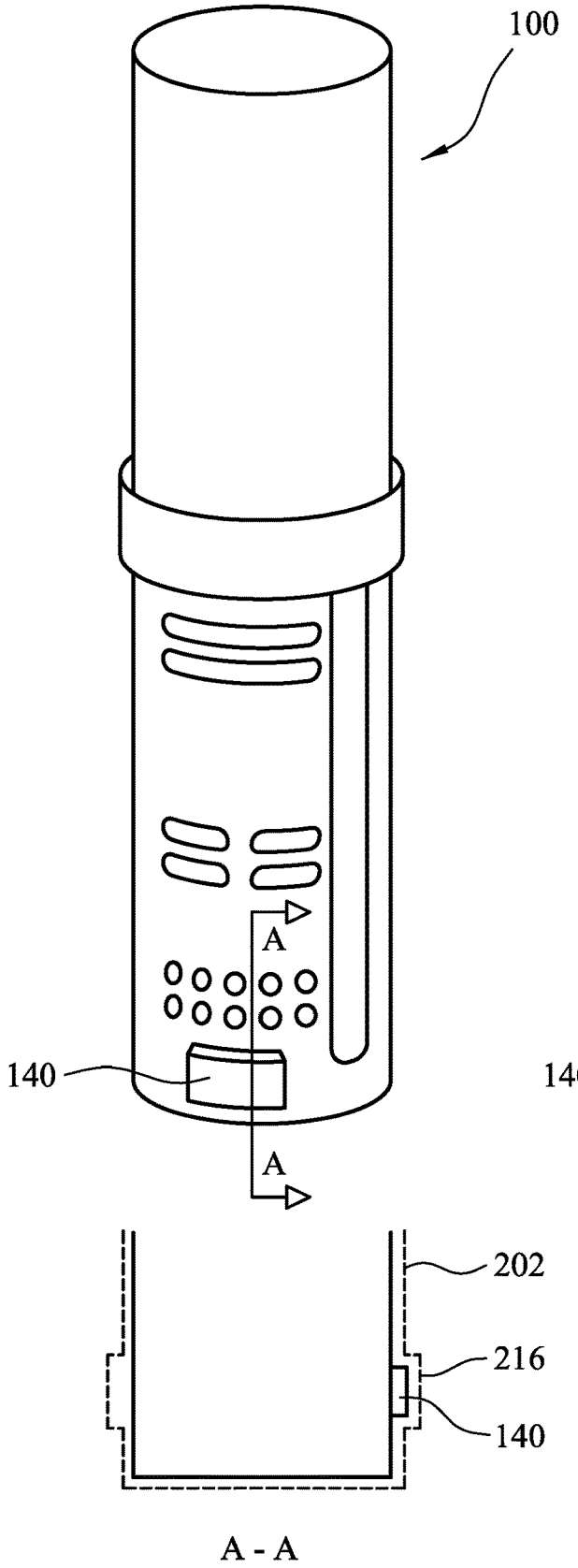
FIG. 5 shows a perspective view of the cartridge of FIG. 1 and a cross-sectional view of a portion of the cartridge when engaged with the device of FIG. 3 prior to use.

FIG. 5 shows the cartridge 100, including the locking component 140, before being heated. Cross-section A-A shows a portion of the cartridge 100 and the chamber 202 of the device of FIG. 3. In this cross-section, the cartridge 100 is engaged with the device, such that a portion of the cartridge 100 is received in the chamber 202 of the device. As can be seen from FIG. 5, in this position, the cartridge 100 could easily be removed from the chamber 202 as the locking component 140 is not engaged with the engagement component 216, or annular recess, of the device so as to discourage disengagement of the cartridge 100 from the device.

Figure 6:
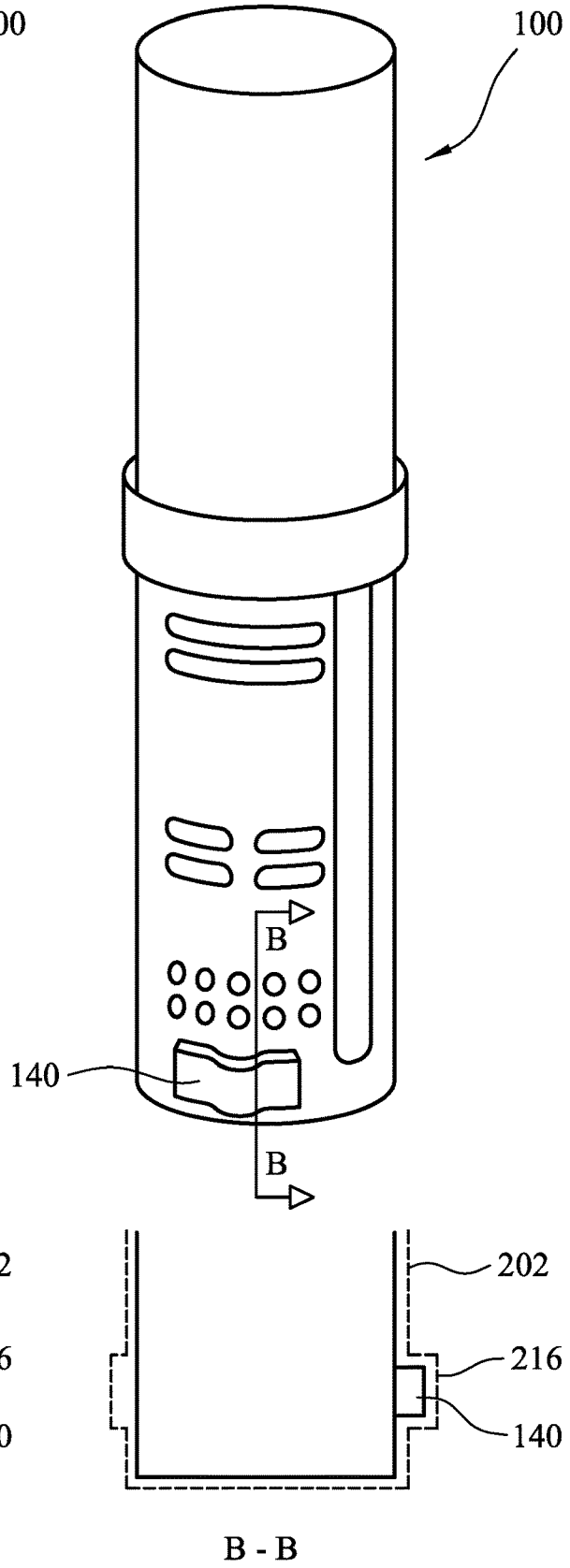
FIG. 6 shows a perspective view of the cartridge of FIG. 1 and a cross-sectional view of a portion of the cartridge when engaged with the device of FIG. 3 during use.

FIG. 6 shows the cartridge 100 including the locking component 140, after being heated as described above. Cross-section B-B shows a portion of the cartridge 100 and the chamber 202 of the device of FIG. 3. In this cross-section, the cartridge 100 is engaged with the device, such that a portion of the cartridge 100 is received in the chamber 202 of the device. As can be seen from FIG. 6, the locking component 140 has been heated so as to expand and engage with the engagement component 216. Specifically, the first strip of steel of the locking component 140 has bowed outwardly from the second strip of steel, or the housing 104, of the cartridge 100 and has been received in the annular recess in the chamber 202 of the device. The recess is annular such that, regardless of the orientation of the cartridge 100 relative to the chamber 202, the locking component 140 will engage with the engagement component 216 when the locking component 140 expands. This engagement between the locking component 140 and the engagement component 216 discourages disengagement of the cartridge 100 from the device because the user cannot now easily pull the cartridge 100 upwards, out of the chamber 202. Once the locking component 140 has cooled again, it will shrink so as to disengage from the engagement component 216 and allow a user to easily remove the cartridge 100 from the chamber 202 again. In this manner, the heat-activated locking mechanism provides a reliable way to prevent a user from touching the housing 104 of the cartridge 100 whilst it may be uncomfortably warm to touch.

In the embodiment described here, the locking component 140 expands sufficiently so as to engage the engagement component 216 and discourage disengagement of the cartridge 100 from the device at temperatures above around 65 degrees Celsius.

In this embodiment, the cartridge 100 comprises the locking component 140 and the device comprises the engagement component 216. However, one skilled in the art would understand that the cartridge 100 could comprise the engagement component 216 and the device could comprise the locking component 140. In this case, the locking component 140 of the device could expand so as to engage with a recess, or a hole, in the cartridge 100.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A ±10% of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. A cartridge for an aerosol-generating device, the cartridge being engageable with and disengageable from the device, the cartridge comprising:

a mouthpiece;

a housing comprising a susceptor material, the housing defining a cavity configured to receive an aerosol-forming substrate; and an ejector, a portion of the ejector being slideable within the cavity so as to eject the aerosol-forming substrate from the cavity.

2. The cartridge according to claim 1, wherein the housing further defines an axial air inlet, a first radial air inlet, and an air outlet downstream of the axial air inlet and the first radial air inlet.

3. The cartridge according to claim 2, wherein the housing further defines a second radial air inlet, the second radial air inlet being spaced from the first radial air inlet axially along the housing.

4. The cartridge according to claim 3, wherein the first radial air inlet comprises a first plurality of holes forming a first annular, air-permeable band in the housing and the second radial air inlet comprises a second plurality of holes forming a second annular, air-permeable band in the housing, the second annular, air-permeable band being spaced axially along the housing from the first air-permeable band.

5. The cartridge according to claim 4, wherein the first air-permeable band has a first permeability to air flow therethrough, and the second air-permeable band has a second permeability to air flow therethrough, and wherein the first permeability is different from the second permeability.

6. The cartridge according to claim 1, wherein an air flow path is defined through the mouthpiece such that air flows through the housing and then through the mouthpiece, and wherein the mouthpiece comprises a constriction zone and an expansion zone, the constriction zone constricting air flow through the mouthpiece and the expansion zone allowing expansion of the air flow in the mouthpiece.

7. The cartridge according to claim 1, wherein the ejector is configured as a stop for the aerosol-forming substrate inserted into the cavity.

8. The cartridge according to claim 1, wherein the housing further comprises a slot which extends axially along the housing, and wherein the slot is configured to allow a user to determine whether the aerosol-forming substrate is located inside the cavity of the housing.

9. The cartridge according to claim 8, wherein the ejector is coupled to the slot.

10. The cartridge according to claim 1, further comprising a locking component of a heat-activated, mechanical locking mechanism and, when the cartridge is engaged with the aerosol-generating device, the locking mechanism is configured to discourage disengagement of the cartridge from the aerosol-generating device if a temperature of a portion of the locking mechanism exceeds a predetermined temperature.

11. The cartridge according to claim 10, wherein the locking mechanism comprises a thermal expansion component, the thermal expansion component being configured to expand when heated to engage with an engagement component of the aerosol-generating device so as to discourage disengagement of the cartridge from the aerosol-generating device.

12. An aerosol-generating system, comprising an aerosol-generating device and a cartridge according to claim 1.

13. The aerosol-generating system according to claim 12, wherein the aerosol-generating device is configured to inductively heat the susceptor material of the cartridge.

14. The aerosol-generating system according to claim 12, wherein the aerosol-generating device comprises a chamber configured to receive the cartridge, a first inductor coil positioned around a first portion of the chamber, and a second inductor coil positioned around a second portion of the chamber, the second portion of the chamber being axially spaced along the chamber from the first portion of the chamber.

15. The aerosol-generating system according to claim 14, wherein the first inductor coil is electrically connected to a first power source and the second inductor coil is electrically connected to a second power source distinct from the first power source.

* * * * *